US007115001B1

(12) United States Patent
Brockman et al.

(10) Patent No.: US 7,115,001 B1
(45) Date of Patent: Oct. 3, 2006

(54) WIRE ACTUATED TERMINAL SPRING CLAMP ASSEMBLY

(75) Inventors: David J. Brockman, Belgium, WI (US); David E Koopmeiners, Franksville, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 11/239,733

(22) Filed: Sep. 30, 2005

(51) Int. Cl.
*H01R 4/48* (2006.01)

(52) U.S. Cl. ..... 439/828; 439/441

(58) Field of Classification Search ..... 439/828, 439/829, 835, 441
See application file for complete search history.

(56) References Cited

U.S. PATENT DOCUMENTS 4,767,340 A * 8/1988 Hohorst ..... 439/729
4,768,981 A * 9/1988 Hohorst ..... 439/835
5,679,021 A * 10/1997 Kramer ..... 439/835
6,875,062 B1 * 4/2005 Bouley et al. ..... 439/834

OTHER PUBLICATIONS

Rockwell Automation, web pages entitled "IEC Terminal Blocks" at www.ab.com; Copyright 2005.

* cited by examiner

*Primary Examiner*—Tulsidas C. Patel
*Assistant Examiner*—Vladimir Imas
(74) *Attorney, Agent, or Firm*—Quarles & Brady, LLP; Alexander M. Gerasimow

(57) ABSTRACT

A spring clamp assembly for an electrical terminal block includes a termination spring, a trigger and a return spring. The trigger is biased by the return spring into an opening of the termination spring to impede a clamping movement of the termination spring. A wire inserted into the terminal block trips the trigger so that it clears the termination spring allowing it clamp the exposed end of the wire against a metal terminal contact. Thus, the wire is clamped in place simply by the simple and necessary action of inserting the wire into the terminal block. The wire is removed and the assembly is reset by manually moving the termination spring to its original position, removing the wire and allowing the return spring to reset the trigger.

17 Claims, 3 Drawing Sheets

WIRE ACTUATED TERMINAL SPRING CLAMP ASSEMBLY

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

The present invention relates to electrical termination blocks and clamps for clamping wires to the terminal contact(s).

Industrial electrical components, such as controls, switches, timers, relays and other components for machine monitoring, control and operator interfacing, typically have terminal blocks with one or more electrical contacts to couple power and/or interconnect wires. Complex wiring applications, such as factory automation, process and motion control, data acquisition, electrical utility, telecommunications, and HVAC applications, typically use a series of modular terminal blocks to couple the wire leads. These terminal blocks are often mounted on a common metal rail known as a "DIN rail".

Conventional DIN mounted modular terminal blocks have a thin, non-conductive body that houses an electrical contact and a wire clamping mechanism. Conventional terminal blocks of screw, spring or insulation displacement types are commercially available from Rockwell Automation of Milwaukee, Wis. as the Allen-Bradley "J", "K" and "L" line of terminal blocks.

The terminal blocks are common in the "feed through" form in which two or more wires are clamped to a metal contact bar inside the terminal block to simply make an electrical connection between the wires. Other terminal blocks have disconnect mechanisms, fuses, thermocouples, diodes, surge protectors and other such components interposed between separate contacts inside the housing for interrupting or otherwise affecting the current path between the wires.

The housings of conventional terminal blocks usually have flexible rail clips that mechanically mount it to the rail. The wire(s) are inserted into the housing and clamped to the contact(s) by a screw or spring inside the housing. The clamp is accessible from outside the housing, but to comply with IP2X "finger-safe" standards, the access opening must be small enough so that a probe approximately the size of a finger cannot make contact with energized parts of the terminal block, namely the contact. Thus, it is conventional to have small funneled openings just large enough to accommodate individual insulated wires. Also, access to the clamping mechanisms is either limited or they are made to be operated by non-conductive parts.

Given the typically large number of wires that must be connected in large industrial applications, it is desirable to make the termination of the wire to the contact as simple and quick as possible. However, the generally enclosed housing of conventional finger-safe terminal blocks can make it difficult to clamp the wire to the terminal contact.

One simple and effective method for terminating the wire to the contact is a "push in" connection in which the exposed end of the wire is clamped to the contact simply by the user inserting the wire into an opening in the terminal block. Existing push in clamp mechanisms typically include a leaf spring that is biased against the contact such that when a wire is inserted therebetween the wire displaces the leaf spring, which in turn provides a biasing force that clamps the wire against the contact. While simple, such systems are only effective for solid wires that have the structural rigidity to displace the leaf spring. Stranded wire lacks sufficient rigidity and thus such systems are not suitable for stranded wire. Another problem with such systems is that it is often difficult to determine whether the wire is securely clamped in place. If the spring fails to clamp the wire adequately, the wire can be dislodged and disrupt the circuit.

Accordingly, an improved wire clamp is desired.

SUMMARY OF THE INVENTION

The present invention provides a spring clamp assembly for a wire terminal that addresses the above problems. The spring clamp assembly of the present invention can be used with solid and stranded wire, and can provide feedback to the user that the wire has been successfully clamped to the terminal contact. Moreover, the spring clamp assembly of the present invention can be used with top, bottom and side wire entry terminal blocks.

In one aspect the present invention provides a spring clamp assembly for securing a wire to a terminal contact. The spring clamp assembly includes a termination member, a trigger and a return member. The termination member provides the wire clamping force and has an opening receiving the wire. The termination member is movable between first and second positions. The first position locates the opening to receive the wire, and the second position biases the wire received in the opening against the contact. The trigger engages the termination member and is movable from an initial position to effect movement of the termination member from the first position to the second position. The return member biases the trigger toward the initial position.

The most preferred form of the spring clamp assembly is arranged to allow the trigger to be tripped by the wire. Thus, by simply inserting the wire into an opening in the terminal block sufficient to contact the trigger, the trigger will release the termination member so that it can clamp the wire against the terminal contact. In this way, no extraneous steps need be undertaken to couple the wire to the terminal contact.

In other forms, the termination member is a leaf spring and movement from the first position to the second position is effected by deflection of a portion of the leaf spring. The return member is a coil spring disposed in to abut a part of the trigger that does not engage the termination spring. The trigger defines a space to receive the end of the wire and has an open side allowing for surface contact with the terminal contact when clamped. The return spring moves essentially along a wire insertion axis and portion of the termination spring moves by deflecting along a path intersecting that axis. When in its initial position the trigger interferes with movement of the termination spring from the first position to the second position preferably by engaging the opening of the termination spring.

In another aspect the invention provides a spring clamp assembly for securing a wire to a terminal contact having a termination member, trigger and return member. The termination member is deflectable between a position in which its opening is located to receive the wire and a position in which the wire is biased against the terminal contact. The trigger initially engages the termination member to interfere with deflection of the termination member from the first position to the second position. The trigger is tripped by contact with the wire to move out of engagement with the termination member and permit deflection of the termination member from the first position to second position.

In still another aspect the invention provides a method of connecting a wire to a terminal contact using a spring clamp assembly. The method includes inserting a wire into the terminal block to trip a trigger against the bias of a return spring, which releases a termination spring to clamp the wire against the terminal contact. Preferably, the wire is inserted into the terminal block until an audible "click" sounds, which notifies the user that proper coupling has been achieved.

These and other advantages of the invention will be apparent from the detailed description and drawings.

DETAILED DESCRIPTION OF THE PREFERRED EMBODIMENT

Figure 1:
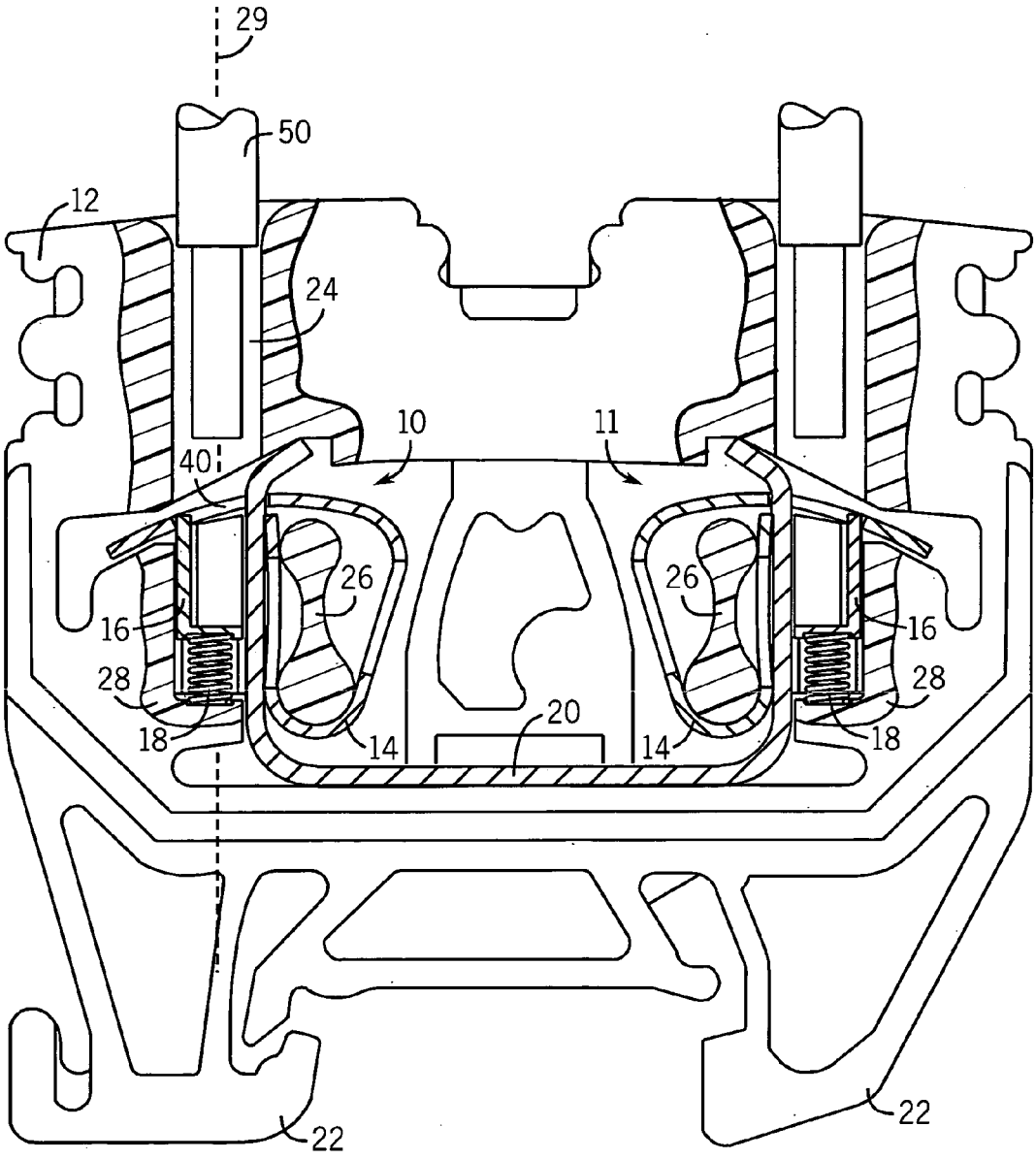
FIG. 1 is a front sectional view of a terminal block having spring clamp assemblies according to the present invention.

FIG. 1 illustrates spring clamp assemblies 10 and 11 for a wire terminal block 12 used to couple wires together or to the electrical contacts of an electrical component. The preferred version of the spring clamp assemblies 10 and 11 disclosed herein each include a termination spring 14, a trigger 16 and a return spring 18. The termination spring 14 is preferably an elongated spring member that is bent to provide a pre-load spring force for clamping the wire, as detailed below. The termination spring 14 can be a leaf type spring made of metal, plastic or other suitable material. The return spring 18 can also be of any suitable type or material, and in one preferred form is a metal coil spring.

As shown, the spring clamp assemblies 10 and 11 can be used to couple two or more wires to a terminal contact 20 in the terminal block 12. The contact 20 is a metallic piece that can take the form of an elongated bus or current bar. In the embodiment shown, the contact bar 20 has a U-configuration so that its upwardly extending legs interplay with each spring clamp assembly 10 and 11. Using the spring clamp assemblies 10 and 11 to clamp a wire conductor to each vertical leg by the contact bar 20 will electrically couple the two wires together.

The terminal block 12 is shown as a modular feed-through type finger-safe terminal block with top wire entry. The terminal block 12 has a non-electrically conductive housing with a wide, thin profile and a hollow interior and two mounting tabs 22 at lower corners that have a standard configuration designed to mate with a standard DIN rail (not shown) and mechanically connect the terminal block to the DIN rail. It should be noted that the spring clamp assembly of the present invention could be used with any other suitable terminal block configuration with top, bottom or side wire entry ports, and therefore the disclosed embodiment is not limiting in this regard.

The terminal block 12 has internal ribbing and wall structure that support and fix the location of the spring clamp assemblies 10 and 11 and the contact bar 20 in relation to two cylindrical openings 24 leading from the top side of the terminal block 12. Specifically, as shown in FIG. 2, each termination spring 14 forms a bend that loops about a dumbbell-shaped wall 26 and the return spring 18 and the trigger 16 are disposed in a pocket of an L-shaped wall 28 so as to be aligned generally with an axis of insertion 29 of the wire through the associated opening 24 in the terminal block 12.

Since both spring clamp assemblies 10 and 11 are identical, for simplicity their construction and operation will be discussed below and illustrated in FIGS. 2 and 3 with reference to only assembly 10. When assembled, the return spring 18 is captured between the horizontal ledge of wall 28 and the bottom wall of the trigger 16. The trigger 16 rests on the return spring 18 so that its open cavity or pocket 30 is generally aligned with the opening 24 in position to receive the wire. The trigger 16 and the return spring 18 thus are movable along the wire insertion axis 29 and are disposed alongside the vertical leg of the contact bar 20. The vertical leg of the contact bar 20 extends alongside a leg of the termination spring 14 that contacts the terminal block wall 26. The contact bar 20 is generally stationary and its vertical leg fits through an opening 40 in a lateral leg of the termination spring 14. The opening 40 is generally disposed about the wire insertion axis 29 in registration with the opening 24. The opening 40 serves to accommodate insertion of the wire into the vicinity of the spring clamp assembly 10 and also provides a location for engaging the wire to apply the clamping force. Thus, the opening 40 can be a hole as shown and described herein or it could by a notch, recess, hook or other structure that both allows space for the wire to pass along the insertion axis 29 and provides a surface for engaging the wire.

Figure 2:
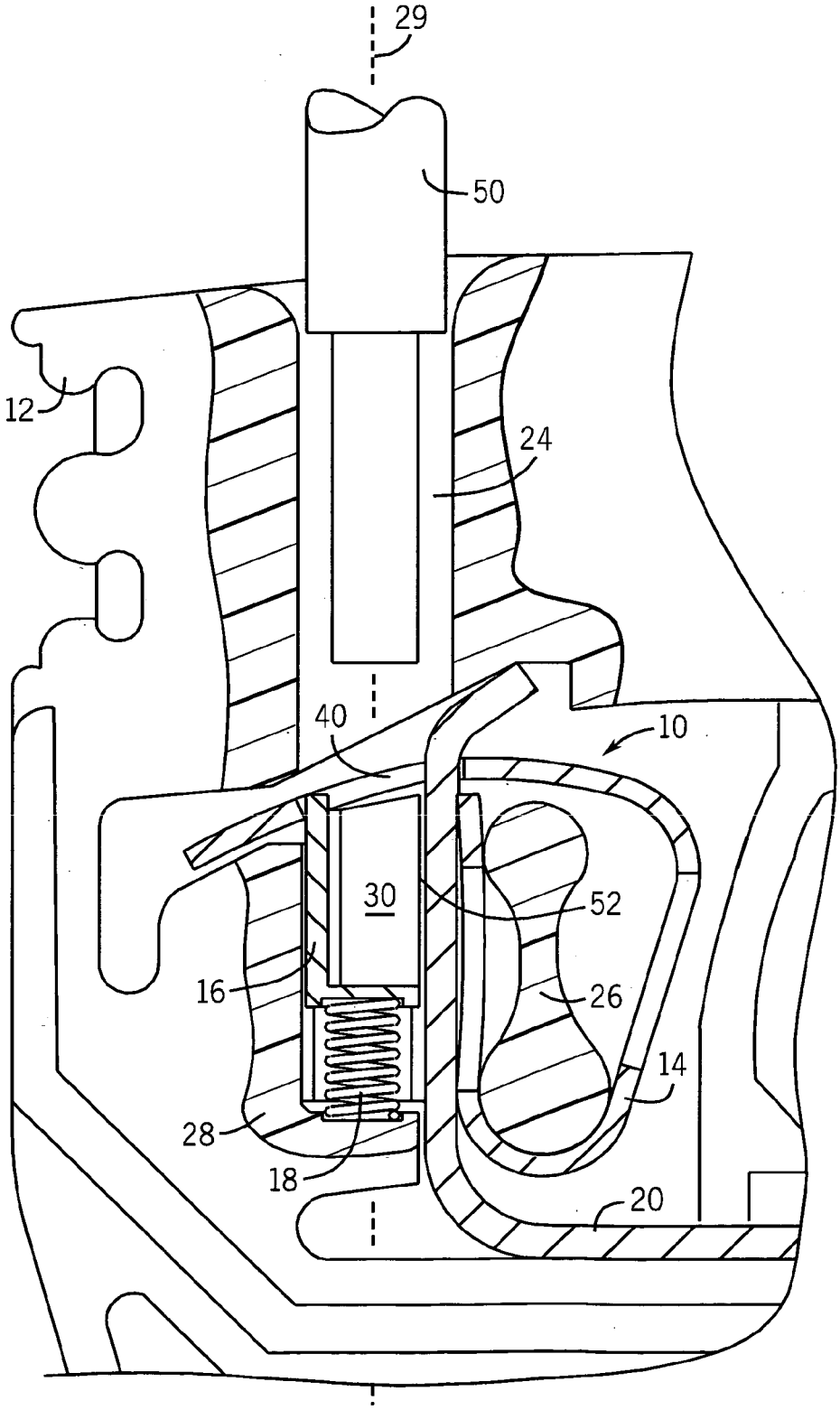
FIG. 2 is an enlarged partial sectional view thereof showing one of the spring clamp assemblies in its open, ready-to-wire position.
Figure 3:
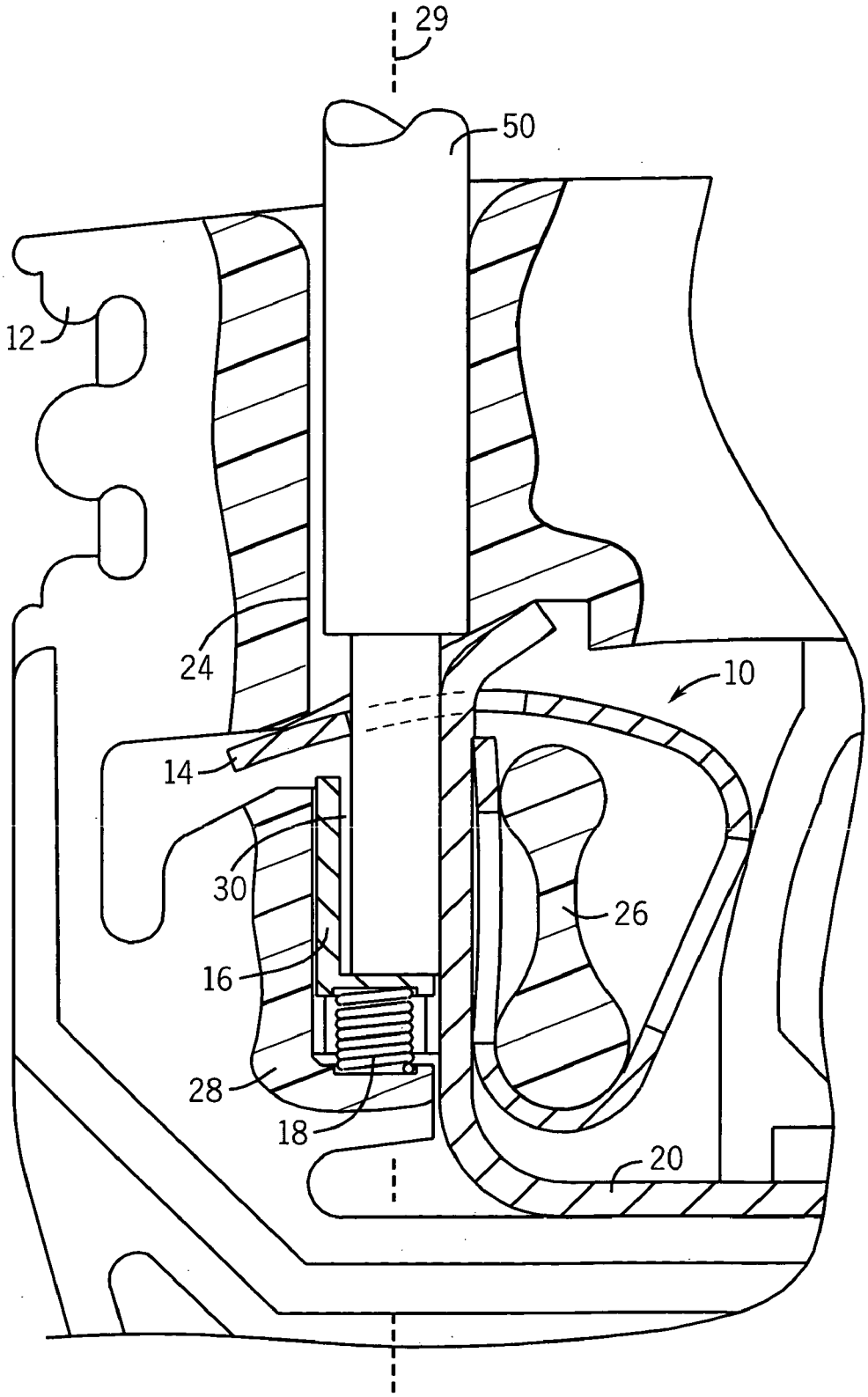
FIG. 3 is view similar to FIG. 2 showing one spring clamp assembly clamping a wire to a terminal contact.

The termination spring 14 moves, by way of flexure or deflection of the lateral leg, from a first position when the spring clamp assembly is in a ready-to-wire state (shown in FIG. 2) to a second position in which it is in a wire clamping state (shown in FIG. 3). In the ready-to-wire state of FIG. 2, the termination spring 14 is in its first position such that upper part of the trigger 16 extends into the opening 40 under the force of the return spring 18. In this state, the trigger 16 interferes with the movement, particularly flexure or deflection, of the termination spring 14 to its second position. Thus, the opening 40 is ready to receive the wire. As shown in FIG. 2, a wire 50 that has its insulation stripped away at one end to expose the conductor is inserted into the opening 24 of the terminal block 12. The wire 50 can be inserted far enough so that the bare end passes through the opening 40 of the termination spring 14 and into the cavity 30 of the trigger 16. When the tip of the wire 50 contacts the bottom of the trigger 16 further insertion will drive the trigger 16 against the return spring 18 so that it moves in the axial direction. Minimal insertion force is required to move the trigger 16 since it is moving the trigger 16 only a short axial distance and the return spring 18 is a relatively low force spring. In any event, the insertion force is generally less than that required to displace the leaf spring in conventional push-in type spring clamp mechanisms. As such, the spring clamp assembly of the present invention is suitable for use with both solid wires and stranded wires. When the trigger 16 moves far enough, its upper end will pass out of the opening 40 and disengage the termination spring 14. When the trigger 16 is tripped, the spring force of the termination spring 14 will cause it to move to its second position shown in FIG. 3. The trigger 16 is open at one side 52 so that the exposed conductor of the wire 50 is clamped against the vertical leg of the contact bar 20 by the clamping force of the termination spring 14, particularly the abutment of the inner periphery of the opening 40 with the wire 50. When the termination spring 14 clamps the wire 50 against the vertical leg of the contact bar 20, an audible "click" can be heard by the user. This provides feedback that the wire 50 was inserted far enough into the terminal block 12 to trip the trigger 16 and that the wire has been successfully clamped to contact bar 20. The spring force of the termination spring 14 maintains a clamping force sufficient to keep the wire conductor in contact with the contact bar 20 absent a significant pulling force on the wire.

To disconnect the wire from the contact bar 20, the termination spring 14 is simply moved back manually to its initial position (as in FIG. 2). This can be accomplished in the enclosed terminal block 12 by fitting the tip of a tool, such as a screwdriver, into an opening (not shown) in the terminal block 12 and forcing the termination spring 14 against its spring force until the return spring 18 drives the trigger 16 back up into the opening 40 in the termination spring 14. The spring clamp assembly 10 is thus reset to the ready-to-wire state of FIG. 2.

The present invention thus provides a simple and easy to operate spring clamp assembly for a wire terminal block. The spring clamp assembly of the present invention can be used with solid and stranded wire, and can provide feedback to the user that the wire has been successfully clamped to the terminal contact. Moreover, the spring clamp assembly of the present invention can be used with top, bottom and side wire entry terminal blocks The invention also provides a method of connecting a wire to a terminal contact using a spring clamp assembly. The method includes inserting a wire into the terminal block to trip a trigger against the bias of a return spring, which causes a termination spring to release and clamp the wire against the terminal contact. Preferably, the wire is inserted into the terminal block until an audible "click" sounds, which notifies the user that proper coupling has been achieved.

A preferred embodiment of the invention has been described above. However, modifications and variations to the preferred embodiment will be apparent to those skilled in the art, which will be within the spirit and scope of the invention. Therefore, the invention should not be limited to just the described embodiment. To ascertain the full scope of the invention, the following claims should be referenced.

What is claimed is:

1. A spring clamp assembly for securing a wire to a terminal contact, the spring clamp assembly comprising:

a termination member having an opening and being movable between first and second positions, the first position being such that the opening is located to receive the wire and the second position being such that the wire received in the opening is biased against the contact;

a trigger engaging the termination member and being movable from an initial position to effect movement of the termination member from the first position to the second position; and a coil spring return member biasing the trigger toward the initial position.

2. The assembly of claim 1, wherein the trigger is actuated by the contact with the wire.

3. The assembly of claim 1, wherein in the initial position the trigger interferes with movement of the termination member from the first position to the second position.

4. The assembly of claim 1, wherein trigger defines a space to receive the wire.

5. The assembly of claim 1, wherein the termination member is a spring and wherein movement from the first position to the second position is effected by deflection of a portion of the leaf spring.

6. The assembly of claim 1, wherein when the trigger is in the initial position and the termination member is in the first position the trigger is disposed within the termination member opening.

7. The assembly of claim 1, wherein the contact extends through the termination member opening.

8. The assembly of claim 1, wherein the return member moves essentially along a wire insertion axis and wherein at least a portion of the termination member moves along a path intersecting the wire insertion axis.

9. A spring clamp assembly for securing a wire to a terminal contact, the spring clamp assembly comprising:

a termination member having an opening and being deflectable between first and second positions, the first position being such that the opening is located to receive the wire and the second position being such that the wire received in the opening is biased against the contact;

a trigger engaging the termination member in an initial position to interfere with deflection of the termination member from the first position to the second position, the trigger being tripped by contact with the wire to move out of engagement with the termination member and permit deflection of the termination member from the first position to second position; and a coil spring return member biasing the trigger toward the initial position.

10. The assembly of claim 9, wherein trigger defines a space to receive the wire.

11. The assembly of claim 9, wherein the termination member is a spring and wherein movement from the first position to the second position is effected by deflection of a portion of the leaf spring.

12. The assembly of claim 9, wherein when the trigger is in the initial position and the termination member is in the first position the trigger is disposed within the termination member opening.

13. The assembly of claim 9, wherein the contact extends through the termination member opening.

14. A method of connecting a wire to a terminal contact using a spring clamp assembly, the method comprising:

inserting a wire into a terminal block having the spring clamp assembly, including:

a termination member having an opening and being movable between first and second positions, the first position being such that the opening is located to receive the wire and the second position being such that the wire received in the opening is biased against the contact;

a trigger engaging the termination member and being movable from an initial position to effect movement of the termination member from the first position to the second position; and a coiled termination spring biasing the trigger toward the initial position;

tripping the trigger of the spring clamp assembly by contact with the wire causing release of the termination spring of the spring clamp assembly; and clamping the wire against the terminal contact under force of the termination spring.

15. The method of claim 14, wherein the wire is inserted into the terminal block until a feedback signal is effected.

16. The method of claim 14, wherein the termination spring defines an opening receiving the wire and engaging the trigger prior to the trigger being tripped.

17. The method of claim 16, wherein the terminal contact is disposed within the opening of the termination spring.

* * * * *